US011441812B2

(12) United States Patent
Yang et al.

(10) Patent No.: US 11,441,812 B2
(45) Date of Patent: Sep. 13, 2022

(54) AIR CONDITIONING INDOOR UNIT

(71) Applicant: DAIKIN INDUSTRIES, LTD., Osaka (JP)

(72) Inventors: Shunbo Yang, Osaka (JP); Wenqing Wu, Osaka (JP); Shengfei Yu, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 349 days.

(21) Appl. No.: 16/625,921

(22) PCT Filed: Jun. 22, 2018

(86) PCT No.: PCT/JP2018/023839
§ 371 (c)(1),
(2) Date: Dec. 23, 2019

(87) PCT Pub. No.: WO2018/235947
PCT Pub. Date: Dec. 27, 2018

(65) Prior Publication Data

US 2020/0158373 A1 May 21, 2020

(30) Foreign Application Priority Data

Jun. 23, 2017 (CN) ..... 201710488034.3
Jun. 23, 2017 (CN) ..... 201710488931.4
Jun. 23, 2017 (CN) ..... 201720744356.5

(51) Int. Cl.
*F24F 13/20* (2006.01)
*F24F 11/88* (2018.01)
(Continued)

(52) U.S. Cl.
CPC ..... *F24F 13/20* (2013.01); *F24F 11/58* (2018.01); *F24F 11/88* (2018.01); *F24F 11/89* (2018.01);
(Continued)

(58) Field of Classification Search
CPC .. F24F 13/20; F24F 13/06; F24F 13/30; F24F 13/32; F24F 13/08; F24F 11/58;
(Continued)

(56) References Cited

U.S. PATENT DOCUMENTS

2008/0047281 A1* 2/2008 Fukushima ..... F24F 1/0047 62/78
2010/0050678 A1 3/2010 Ikeda et al.
(Continued)

FOREIGN PATENT DOCUMENTS

CN 105444268 A 3/2016
CN 106091125 A 11/2016
(Continued)

OTHER PUBLICATIONS

International Preliminary Report on Patentability issued in corresponding International Patent Application No. PCT/JP2018/023839, dated Jan. 2, 2020 (10 pages).
(Continued)

*Primary Examiner* — Emmanuel E Duke
(74) *Attorney, Agent, or Firm* — Osha Bergman Watanabe & Burton LLP

(57) ABSTRACT

An air conditioning indoor unit includes: a main body that includes: a top side; a bottom side; a side part that connects the top side to the bottom side; and an intake surface on the side part; a blow-out panel that covers the bottom side of the main body and that includes a blow-out port; an axial fan inside the main body; a heat exchanger inside the intake surface; and an electric component under the axial fan. The axial fan has an axial direction orthogonal to the top side, and an intake side and a blow-out side when the axial fan is in rotation. The blow-out side is disposed on a lower side of the axial fan and faces the blow-out panel. The heat exchanger surrounds the axial fan.

15 Claims, 7 Drawing Sheets

(51) Int. Cl.

| | |
|---|---|
| ***F24F 11/89*** | (2018.01) |
| ***F24F 11/58*** | (2018.01) |
| ***F24F 13/06*** | (2006.01) |
| ***F24F 13/30*** | (2006.01) |
| ***F24F 13/32*** | (2006.01) |

(52) U.S. Cl.
CPC ..... *F24F 13/06* (2013.01); *F24F 13/30* (2013.01); *F24F 13/32* (2013.01); *F24F 2013/205* (2013.01); *F24F 2221/14* (2013.01)

(58) Field of Classification Search
CPC ..... F24F 11/88; F24F 11/89; F24F 2013/205; F24F 2221/14; F24F 1/0047; F24F 1/0059; F24F 1/0029
See application file for complete search history.

(56) References Cited

U.S. PATENT DOCUMENTS

| | | | | |
|---|---|---|---|---|
| 2010/0175399 | A1* | 7/2010 | Choi | F24F 1/0047 62/186 |
| 2010/0175418 | A1* | 7/2010 | Choi | F24F 1/0073 62/419 |
| 2011/0240255 | A1 | 10/2011 | Sakashita | |
| 2015/0201519 | A1* | 7/2015 | Kaneoya | H05K 5/0247 361/752 |
| 2016/0223211 | A1* | 8/2016 | Xue | F24F 1/0047 |
| 2017/0205083 | A1* | 7/2017 | Obara | F24F 13/222 |
| 2017/0307232 | A1* | 10/2017 | Nouchi | F24F 13/20 |
| 2017/0328580 | A1* | 11/2017 | Furuta | F24F 1/0047 |
| 2018/0106484 | A1* | 4/2018 | Swanson | F24F 13/10 |

FOREIGN PATENT DOCUMENTS

| | | | |
|---|---|---|---|
| JP | 2010-164294 | A | 7/2010 |
| JP | 2012-78085 | A | 4/2012 |
| KR | 20060128172 | A | 12/2006 |

OTHER PUBLICATIONS

International Search Report issued in corresponding International Application No. PCT/JP2018/023839 dated Aug. 14, 2018, with translation (4 pages).
Written Opinion of the International Searching Authority issued in corresponding International Application No. PCT/JP2018-023839 dated Aug. 14, 2018 (5 pages).
Extended European Search Report issued in corresponding European Patent Application No. 18820840.9 dated Apr. 20, 2020 (8 pages).

* cited by examiner

AIR CONDITIONING INDOOR UNIT

TECHNICAL FIELD

The present invention relates to an air conditioning indoor unit.

BACKGROUND

A conventional ceiling suspended air conditioning indoor unit is mounted inside a ceiling inside a room. A blow-out panel is fitted with a fitting hole on the ceiling. Such an air conditioning indoor unit is typically used in an office environment.

The air conditioning indoor unit mounted in a ceiling suspended state does not use a wall surface and does not conflict with furniture layout inside the room. Thus, the ceiling suspended air conditioning indoor unit is widely used. However, since the most part of the volume of such an air conditioning indoor unit is housed above the ceiling, a large space above the ceiling is required for mounting the air conditioning indoor unit. Typically, a space of 40 cm or larger (the height of the space) is required. Thus, it is still necessary to reduce the height dimension of the ceiling suspended air conditioning indoor unit.

On the other hand, an electric component is typically disposed outside a case in the ceiling suspended air conditioning indoor unit, which is extremely inconvenient for maintenance. Further, the blow-out panel of the ceiling suspended air conditioning indoor unit is typically provided with a blow-out port facing four directions so as to uniformly blow air flows in the respective directions inside the room. However, an air-blowing condition by the conventional ceiling suspended air conditioning indoor unit is limited by the layout of an internal member of the indoor unit, and air flows generated by the rotation of a fan often do not flow toward the blow-out port. Further, in the conventional ceiling suspended air conditioning indoor unit, the air volume at each blow-out port is not uniform. Further, air generated by the ceiling suspended air conditioning indoor unit is typically blown downward, which limits the range of air-blowing and deteriorates comfort for human.

The blow-out port may be disposed on the blow-out panel over the whole circumference thereof. However, the air volume differs between respective parts of the blow-out port, and no air is blown out through some parts (in particular, the corners of a quadrate blow-out panel). Thus, it is still necessary to improve the conventional ceiling suspended air conditioning indoor unit to improve the uniformity of air-blowing by the air conditioning indoor unit.

SUMMARY

An air conditioning indoor unit according to one or more embodiments of the present invention includes a main body and a blow-out panel. The main body includes a top side, a bottom side, and a side part connecting the top side to the bottom side, and includes an intake surface on the side part. The blow-out panel at least partially covers the bottom side of the main body and includes a blow-out port. An axial fan is disposed inside the main body. An axial direction of the axial fan is orthogonal to the top side. An intake side and a blow-out side are formed during rotation of the axial fan, the blow-out side is located on a lower side of the axial fan, and the blow-out side faces the blow-out panel. The air conditioning indoor unit further includes a heat exchanger and an electric component. The heat exchanger is located inside the intake surface and disposed surrounding the axial fan. The electric component is disposed under the axial fan.

In this configuration, the electric component is disposed under the axial fan. Thus, the overall size of the air conditioning indoor unit is reduced. That is, such a disposed position of the electric component reduces the overall height of the air conditioning indoor unit and also reduces the influence of the electric component on air flows to be blown out.

According to one or more embodiments of the present invention, the air conditioning indoor unit further includes a housing for housing the electric component. Such a housing simplifies the mounting structure of the electric component and improves the production efficiency of the air conditioning indoor unit.

The housing may be at least partially fitted into a central part surrounded by a fin of the axial fan. The mounting of the housing sufficiently utilizes a space on the central part of the axial fan and further reduces the overall height of the air conditioning indoor unit.

The housing may include an air guide structure disposed on one side facing the axial fan. The air guide structure disposed on the housing guides air flows blown out of the axial fan to the blow-out port and achieves nearly smooth and uniform blowing-out by the air conditioning indoor unit.

The air guide structure may be an air guide piece. The air guide piece is disposed on an edge of the housing. Using the air guide piece simplifies the structure and facilitates processing. Further, it is possible to excellently guide air flows to the blow-out port of the blow-out panel to also achieve an excellent air guide effect.

The air guide structure may include a first air guide piece including an intake part and a blow-out part. The blow-out part is distorted toward a corner of the blow-out panel and/or a corner of the main body. The distorted blow-out part of the first air guide piece guides air flows blown out of the axial fan to the corner, achieves smooth blowing-out from the corner, and achieves uniform blowing-out by the entire blow-out panel.

The axial fan may rotate in a first direction so that air flows are drawn through the intake surface and blown out through the blow-out port. The housing is fixed to the main body or the blow-out panel with a support rod. The air guide structure includes a first air guide piece. The first air guide piece is disposed downstream of the support rod in the first direction. In this configuration, the support rod enhances the fixing strength of the housing. Further, the first air guide piece is disposed downstream of the support rod to guide air flows flowing downstream of the support rod. Accordingly, an air flow loss on the downstream side relative to the support rod is reduced. As compared to a case where the support rod is disposed on the upstream side, the interruption of air flows is further reduced in the case where the support rod is disposed on the downstream side.

On a plane orthogonal to an axis of the axial fan, when $\alpha$ denotes an angle between a tangent to the blow-out part of the first air guide piece at an end point and a straight line formed by projecting the support rod on the plane, the angle $\alpha$ may satisfy $5° \leq \alpha \leq 15°$. Such setting of the angle of the blow-out part facilitates guiding of air flows to the corner.

The blow-out panel may include a corner, and the support rod is displaced by a certain distance from the corner toward a downstream side in the first direction. Further, on a plane orthogonal to an axis of the axial fan, an angle $\theta$ between the support rod and a center line of the housing, the center line extending orthogonal to an air guide fin of the blow-out panel, may be within a range of 10° to 15°. Such setting of the angle of the support rod contributes to further reducing the interruption of air flows at the corner by the support rod, achieves smooth air flows at the corner, and achieves uniform blowing-out by the entire blow-out panel.

The intake part of the first air guide piece may include a windward surface and a leeward surface. An angle β1 is set between a tangent to the windward surface at an intake end point and a center line of the housing, the center line being orthogonal to an air guide fin of the blow-out panel. An angle β2 is set between a tangent to the leeward surface at the intake end point and the center line of the housing, the center line being orthogonal to the air guide fin of the blow-out panel. Further, the angle β1 is smaller than the angle β2. It is advantageous that the angle β1 of the windward surface of the first air guide piece is set so as to easily guide air flows flowing through the windward surface side to the corner, the angle β2 of the leeward surface is set so as to easily guide air flows flowing through the leeward surface side to the corner, and the angle β1 is smaller than the angle β2. The two side surfaces of the air guide piece match with the first direction in which air flows travel, which contributes to more excellently guiding air flows to the corner of the blow-out panel.

When β1 denotes an angle between the tangent to the windward surface and the center line of the housing, the angle β1 may satisfy $13° \leq \beta1 \leq 23°$. Further, when β2 denotes an angle between the tangent to the leeward surface and the center line of the housing, the angle β2 satisfies $25° \leq \beta2 \leq 35°$.

The air guide piece may extend beyond an edge of the housing. The air guide piece extends to the edge of the housing from any one position between the center point and the edge of the housing.

In the radial direction with respect to the axis of the axial fan, the outer edge of the first air guide piece may be located inside the outer edge of the fin of the axial fan in the radial direction. Accordingly, it is possible to more excellently guide air flows to the blow-out port, reduce the interruption of air flows by the air guide piece, and ensure a sufficient amount of air to be blown.

According to one or more embodiments of the present invention, the axial fan rotates in a first direction so that air flows are drawn through the intake surface and blown out through the blow-out port. The housing further includes a second air guide piece disposed downstream of the first air guide piece in the first direction. The first air guide piece and the second air guide piece guide air flows to an air guide fin on the same side of the blow-out panel. The second air guide piece includes an intake part and a blow-out part. The blow-out part of the second air guide piece is substantially orthogonal to the air guide fin of the blow-out panel. Air flows at respective positions in the first direction in which air flows travel can be guided by disposing the first air guide piece and the second air guide piece which are separated from each other. Further, the second air guide piece guides air flows to the straight edge of the blow-out panel, achieves uniform blowing-out by the blow-out panel, and achieves an air blowing effect at 360°.

According to one or more embodiments of the present invention, the housing further includes a third air guide piece disposed downstream of the second air guide piece in the first direction. The first air guide piece, the second air guide piece, and the third air guide piece guide air flows to the air guide fin on the same side of the blow-out panel.

According to one or more embodiments of the present invention, the housing includes a center line. The first air guide piece includes a windward surface and a leeward surface. A tangent to the leeward surface of the first air guide piece at a point having a shortest distance from the center line is substantially parallel to the center line.

According to one or more embodiments of the present invention, the housing includes a center line, and a line connecting an intake end point to a blow-out end point on a windward surface of the first air guide piece is substantially parallel to the center line.

According to one or more embodiments of the present invention, the housing includes a center point. The second air guide piece includes a windward surface and a leeward surface. A tangent to the leeward surface of the second air guide piece at an intake end point passes through the center point of the housing.

According to one or more embodiments of the present invention, the second air guide piece extends beyond an edge of the housing. The second air guide piece includes a windward surface and a leeward surface. A line L2 connects an intake end point to a blow-out end point on the windward surface of the second air guide piece, and the leeward surface of the second air guide piece and the edge of the housing intersect each other at a second point. A line L3 connects the second point to the center point of the housing, and the line L2 is substantially parallel to the line L3.

According to one or more embodiments of the present invention, the second air guide piece includes a windward surface and a leeward surface. The second air guide piece extends beyond an edge of the housing. The windward surface of the second air guide piece and the edge of the housing intersect each other at a first point. A line L4 connects the first point to an intake end point on the second air guide piece. An angle α2 is set between the line L4 and the center line, and the angle α2 satisfies $12° \leq \alpha2 \leq 25°$.

According to one or more embodiments of the present invention, the housing has a quadrate shape. When N air guide pieces are disposed on an edge on the one side of the housing (N is a natural number of 2 or larger), the air guide pieces are disposed at positions set by equally dividing the edge on the one side of the housing by N+1.

According to one or more embodiments of the present invention, the housing has a quadrate shape. When N air guide pieces are disposed on an edge on the one side of the housing (N is a natural number of 2 or larger), the intersections between the leeward surfaces of the air guide pieces and the edge of the housing are disposed at positions set by equally dividing the edge on the one side of the housing by N+1. The air guide pieces equally disposed on the housing achieve uniform distribution of air flows flowing along the surface of the housing.

According to one or more embodiments of the present invention, the air guide piece is parallel to an axis of the axial fan. That is, the air guide piece is substantially vertically disposed on the edge of the one side face of the housing facing the axial fan. The disposition of the air guide structure achieves uniform distribution of blown-out air flows and actually achieves air-blowing at 360°.

The support rod may include a windward side facing air flows and a leeward side opposed to air flows. The support rod includes a wiring part disposed on the leeward side. The mounting structure of the housing is simple, and the interruption of air flows by the support rod is small.

According to one or more embodiments of the present invention, the air conditioning indoor unit further includes a cover plate. The cover plate is disposed on a center of the blow-out panel and aligned with the electric component. The electric component includes one or more of an electric box, a control device, an LED light, a wireless communication device, an air valve, a motor-operated valve, and a projector device. The cover plate improves the appearance of the indoor unit and provides the electric component with further protection to improve safety.

According to the air conditioning indoor unit according to one or more embodiments of the present invention, the axial fan draws air from the side part and blows out air from the bottom side. Thus, the overall size of the air conditioning indoor unit in the vertical direction can be reduced, which makes it possible to reduce the height of a space above the ceiling. The overall height of the indoor unit is reduced while satisfying a requirement for the cooling efficiency. The intake port and the blow-out port in the air conditioning indoor unit are not disposed on the same plane. As compared to the conventional indoor unit, the size of the indoor unit according to one or more embodiments of the present invention in the horizontal direction is reduced.

For example, specifications of a buckle plate of an integrated ceiling include 300 mm×300 mm and 600 mm×600 mm. In order to facilitate mounting, the blow-out panel may be set to a size slightly larger than 600 mm×600 mm. On the other hand, a case to be fitted inside the ceiling may be set to a size slightly smaller than 600 mm×600 mm. The air conditioning indoor unit having such a size can be particularly applied to mounting to the integrated ceiling. The air conditioning indoor unit 1 according to one or more embodiments of the present invention may be mounted after removing four ceiling modules in the case of the specification of 300 mm×300 mm or removing one ceiling module in the case of the specification of 600 mm×600 mm. It is not necessary to perform another operation, such as opening hole, on the ceiling modules. The size of the indoor unit main body is substantially smaller than a mounting opening formed by the four ceiling modules, which facilitates the mounting. The size of the blow-out panel is substantially larger than the mounting opening formed by the four ceiling module. Thus, the appearance of the mounting is enhanced. Further, the air conditioning indoor unit having such a configuration may be mounted inside an opening open on the integrated ceiling.

Further, the electric component of the air conditioning indoor unit according to one or more embodiments of the present invention is mounted in intimate contact with the blow-out panel on the blow-out side of the axial fan. Thus, maintenance of the electric component is extremely easy. The operation can be performed from under the ceiling by merely removing the cover plate which is located in the intermediate part of the blow-out panel.

Further, air flows blown out through a space between the edge of the air guide ring and the edge of the housing are uniformly distributed at 360° around the rotation axis by the arrangement of the support rod and the air guide piece of the housing for the electric component. At the same time, blowing-out by the air conditioning indoor unit is smooth and uniform, saves energy, and improves comfort for human by the joint action with the air guide fin which is individually controlled by a stepping motor.

In the air conditioning indoor unit according to one or more embodiments of the present invention, the air guide piece is disposed on the housing for the electric component located on the blow-out side under the axial fan. Thus, air flows blown out of the axial fan are uniformly distributed. In particular, the blow-out part of the air guide piece is distorted to the corner of the blow-out panel or the corner of the main body. Such a configuration reduces an air flow loss at the corner and achieves air-blowing at 360° by the blow-out panel.

The support rod for holding the housing is displaced by a certain distance from the corner of the main body or the blow-out panel to the downstream side in the rotation direction of the axial fan. Thus, interruption of air flows at the corner is reduced.

Further, the intake part and the blow-out part of the air guide piece at the edge of the housing are set at specific angles with respect to the center line of the housing. In the intake part, the angle between the windward surface and the center line differs from the angle between the leeward surface and the center line. Thus, air flows are extremely uniformly blown out through the blow-out port, which improves comfort for human.

Further, in the air conditioning indoor unit according to one or more embodiments of the present invention, the interruption action to air flows by the air guide piece is extremely small. Thus, noise to be generated is reduced.

DETAILED DESCRIPTION

Hereinbelow, the present invention will be further described with reference to specific embodiments and the accompanying drawings. In the following description, more details are described for sufficient understanding of the present invention. However, it is apparent that the present invention may be implemented by various other methods different from the description. Those skilled in the art can make modifications depending on actual application conditions without departing from the gist of the present invention. Thus, the protection range of the present invention should not be limited by the specific embodiments thereof.

Figure 1:
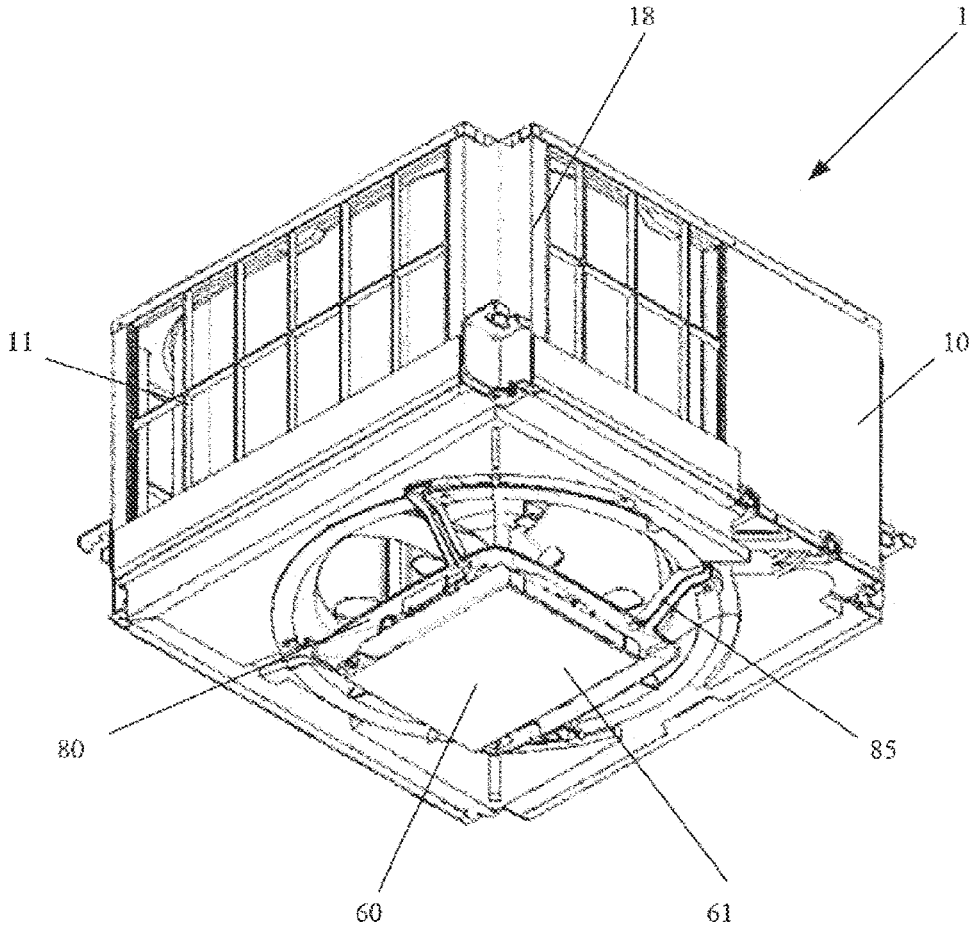
FIG. 1 is a perspective view of an air conditioning indoor unit according to one or more embodiments of the present invention in which a blow-out panel is not illustrated to show a partial internal structure.
Figure 2:
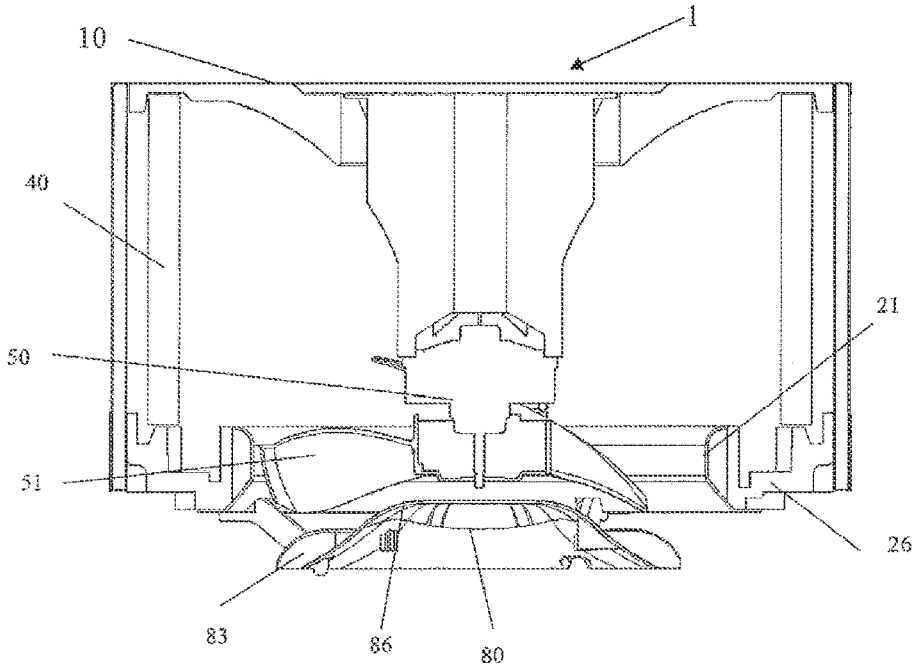
FIG. 2 is a side sectional view of the air conditioning indoor unit according to one or more embodiments of the present invention.

FIG. 1 is a perspective bottom view illustrating a mounted state of an air conditioning indoor unit 1 according to the present invention. The air conditioning indoor unit 1 mainly includes two parts including a main body 10 and a blow-out panel 30 (refer to FIGS. 3 and 8). The main body 10 is typically mounted inside a ceiling of a room. The blow-out panel 30 is attached to the main body 10 under the ceiling to cover a mounting opening open on the ceiling. The main body 10 commonly includes a case 18 and a main body internal member. The case 18 is typically an outer frame made of metal. As illustrated in FIGS. 1 and 2, the main body internal member mainly includes fixed members dispose inside the case 18, such as an air guide ring 21 and a drain board 6. The main body internal member is fitted and mounted inside the case 18. The main body 10 of the air conditioning indoor unit 1 further includes a heat exchanger 40, an axial fan 50, and an electric component 60 all of which are housed in an internal chamber formed by the case 18.

Figure 3:
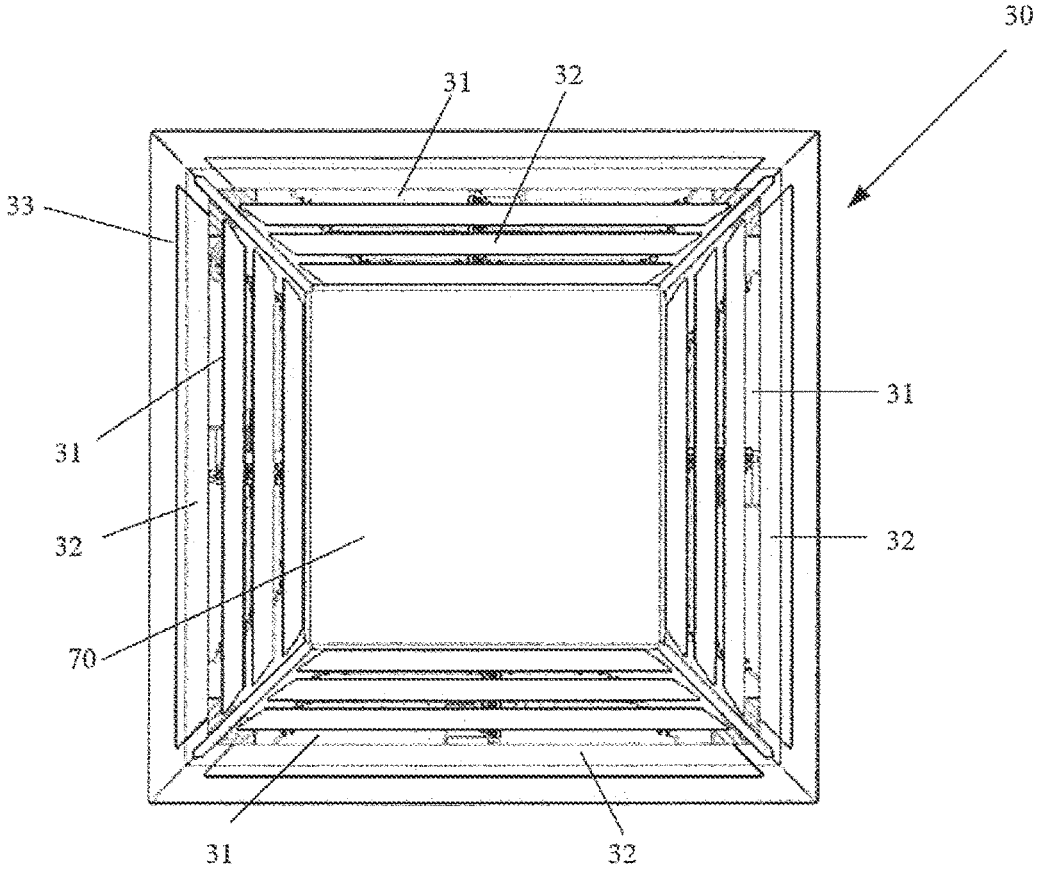
FIG. 3 is a front view of the blow-out panel of the air conditioning indoor unit according to one or more embodiments of the present invention.

As illustrated in FIG. 1, the air conditioning indoor unit 1 has a substantially rectangular parallelepiped shape as a whole. That is, the section of the air conditioning indoor unit 1 in the horizontal direction has a substantially square shape. As illustrated in FIG. 3, the blow-out panel 30 has a substantially square shape. The blow-out panel 30 is fitted with the main body 10 having a rectangular parallelepiped shape in the air conditioning indoor unit 1 for use. According to one or more embodiments of the present invention, the main body 10 of the air conditioning indoor unit 1 includes a top side, a bottom side which is opposed to the top side, and four side parts 11 which connect the top side to the bottom side. In a normal mounted state of the air conditioning indoor unit 1 according to the present invention, the top side of the main body 10 faces upward, and the bottom side of the main body 10 faces downward and is connected to the blow-out panel 30. An intake surface through which air flows flow in is formed on each of the side parts 11 of the main body 10. On the other hand, the blow-out panel 30 located on the bottom side of the main body 10 is provided with a blow-out port 31 so that an air-blowing surface through which air flows flow out is formed.

Figure 8:
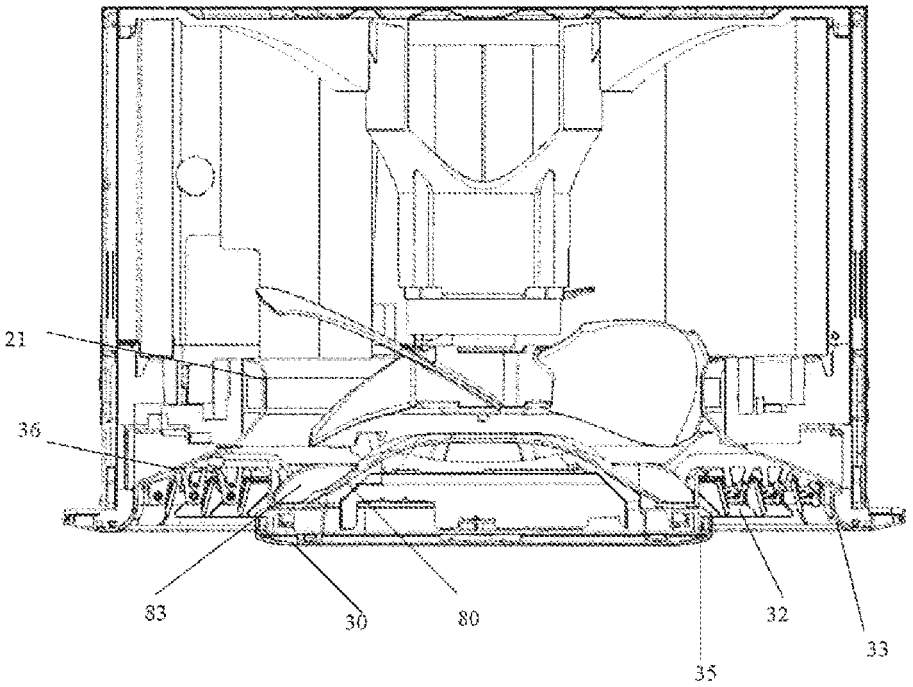
FIG. 8 is a side sectional view of the air conditioning indoor unit according to one or more embodiments of the present invention illustrating a blow-out panel.

As illustrated in FIG. 8, the blow-out panel 30 includes an inner frame 35, an outer frame 33, the blow-out port 31 which is interposed between the inner frame 35 and the outer frame 33, and an air guide fin 32 which is pivotally supported on the blow-out panel 30. Although the illustrated blow-out panel 30 has a square shape, the blow-out panel 30 may have another polygonal shape. The blow-out panel 30 of the air conditioning indoor unit 1 is provided with the blow-out port 31 so that the air-blowing surface through which air flows flow out is formed.

The case 18 may include a cover plate with no hole on the top side thereof. The cover plate is typically made of metal. Some ribs may be disposed on the metal cover plate to serve as a reinforcing structure. In the air conditioning indoor unit 1 according to the present invention, when the axial fan 50 is used, that is, the axial fan 50 operates, a fin 51 pushes air so that the air flows in the same direction as the axis of the fan 50. As illustrated in FIG. 2, the axial fan 50 is attached in such a manner that the rotation axis thereof is substantially orthogonal to the top side of the case 18 and the blow-out side of the axial fan 50 faces the air-blowing surface of the blow-out panel 30. In the operation of the air conditioning indoor unit 1, the fin 51 of the axial fan 50 rotates around the rotation axis (e.g., in the clockwise direction in FIG. 5 which is a first direction) so that air flows are drawn through the intake surface of the side part of the case 18, supplied to the blow-out panel 30 through the air guide ring 21 along the axial direction of the axial fan 50, and finally flow out through the blow-out port 31 of the blow-out panel 30. In an air guide path in the present invention, it is not necessary to particularly form an air flow intake port having a large area on the top side of the case 18 of the air conditioning indoor unit 1.

Further, as illustrated in FIG. 2, the heat exchanger 40 of the air conditioning indoor unit 1 surrounds the axial fan 50 along the intake surface of the case 18. The heat exchanger 40 is located between the intake surface of the case 18 and the intake side of the axial fan 50 along the air flow path of the air conditioning indoor unit 1. Air flows that have entered the air conditioning indoor unit 1 through the intake surface exchange heat in the heat exchanger 40 and then enter the axial fan 50. The heat exchanger 40 may extend surrounding the axial fan 50.

According to one or more embodiments of the present invention, as illustrated in FIG. 2, an air guide member of the main body 10 mainly includes the air guide ring 21. The air guide ring 21 surrounds the fin 51 of the axial fan 50. The air guide ring 21 is disposed substantially coaxially with the fin 51. The air guide ring 21 includes an intake edge which expands outward and a blow-out edge which expands outward. The drain board 26 is disposed under the heat exchanger 40 so as to collect condensed water. The air guide member may further include an air guide inner frame (not illustrated) which is disposed between the blow-out panel 30 and the drain board 26.

According to one or more embodiments, the drain board 26 is made of a foamed material, and the air guide ring 21 is made of a resin material. The drain board 26 and the air guide ring 21 may be integrally molded. The intake edge and the blow-out edge of the air guide ring 21 are both connected to the drain board 26. The blow-out edge of the air guide ring 21 is connected to the lower face of the drain board 26, the lower face facing the blow-out panel 30. Since the drain board 26 and the air guide ring 21 are integrally formed as one main body internal member, the attachment of the drain board 26 and the air guide ring 21 can be completed merely by fitting the main body internal member with the inside of the case 18.

FIG. 3 is a front view of the blow-out panel 30 of the air conditioning indoor unit 1 according to the present invention. As shown in FIG. 3, the blow-out panel 30 has a substantially square shape. The blow-out port 31 surrounds the peripheral edge of the entire square. Specifically, in the blow-out panel 30, each blow-out port 31 has a trapezoidal shape. Four trapezoidal blow-out ports 31 are disposed surrounding the periphery of the blow-out panel 30. The sides of the blow-out ports 31 are adjacent to each other to form a blow-out port of 360°. The adjacent blow-out ports 31 may be separated by a support 33 which pivotally supports and holds the air guide fin 32. A plurality of air guide fins 32 are attached to each blow-out port 31. The air guide fins 32 are substantially parallel to the edge of the blow-out panel 30. The length of each of the air guide fins 32 is gradually reduced toward the inside from the outside. The supports 33 of the blow-out panel 30 pivotally support the air guide fins 32. The air guide fins 32 rotationally move between a closed position and an open position in accordance with a command by control by a motor.

Although the illustrated blow-out panel 30 has a quadrate shape, the blow-out panel 30 may have another polygonal shape. Also when the blow-out panel is formed in a polygonal shape, the blow-out port should still surround the whole circumference of the blow-out panel to form a blow-out port of 360°. For example, the blow-out panel 30 may be formed in a polygonal shape or a circular shape.

A drive device of the air guide fin may include a stepping motor. In particular, the stepping motor is disposed at a position inside the blow-out panel 30 and on substantially the center in the longitudinal direction of the air guide fin 32. In particular, the air guide fin 32 of one blow-out port 31 is individually controlled to drive by one stepping motor. Such installation of the stepping motor can contribute, in particular, to achieving blow-out in all directions by the blow-out panel 30 and achieve individual control with respect to the air guide fins 32 in different directions, which optimizes an air guide effect and improves comfort. The air conditioning indoor unit 1 according to one or more embodiments of the present invention further includes the electric component 60. The electric component 60 described herein includes one or more of an electric box, a control device, an LED light, a wireless communication device (e.g., WIFI, Bluetooth, or Zigbee (registered trademark)), an air valve, a motor-operated valve, and a projector device. In order to facilitate maintenance of the electric component 60 while downsizing the entire air conditioning indoor unit, the electric component 60 is disposed on the blow-out side of the axial fan 50. As shown in FIG. 1, the electric component 60 is disposed directly under the axial fan 50 in the axial direction. In the air flow passage, the electric component 60 is disposed downstream of the axial fan 50 and upstream of the blow-out port 31 of the blow-out panel 30.

The electric component 60 illustrated in FIGS. 1 and 2 is an electric box 61. The electric box 61 typically includes a quadrate metal box. As illustrated in FIG. 2, the blow-out ports 31 are disposed around the electric component 60. The bottom of the electric box 61 is basically flush with the plane (the lower face) of the blow-out panel 30. A cover plate 70, which is removably attached to the intermediate part of the blow-out panel 30, is substantially aligned with the electric box 61. The bottom of the electric box 61 may be in intimate contact with the cover plate 70 (refer to FIG. 3).

Figure 4:
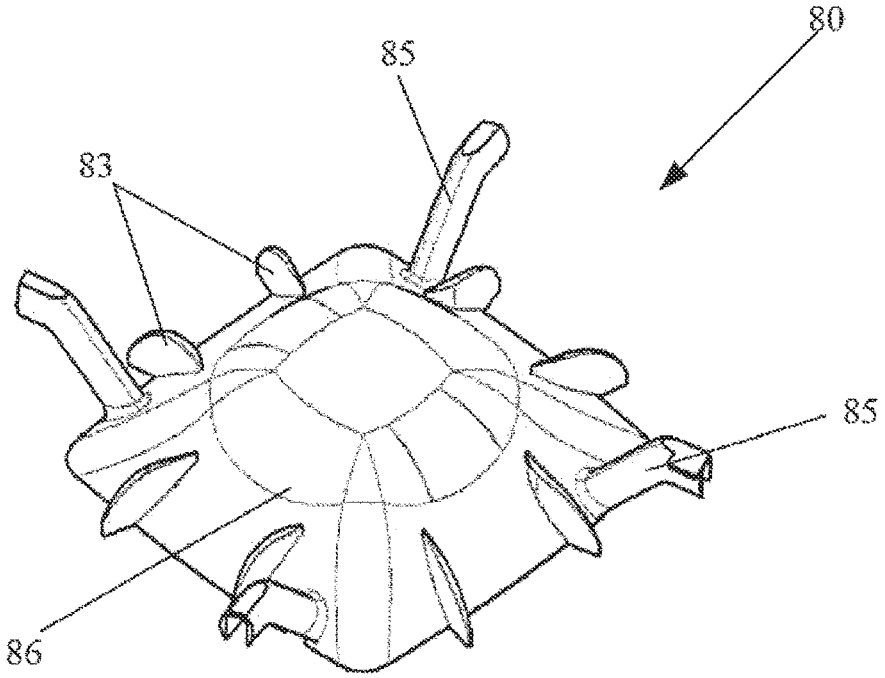
FIG. 4 is a three-dimensional view of a housing for housing an electric component according to one or more embodiments of the present invention.
Figure 5:
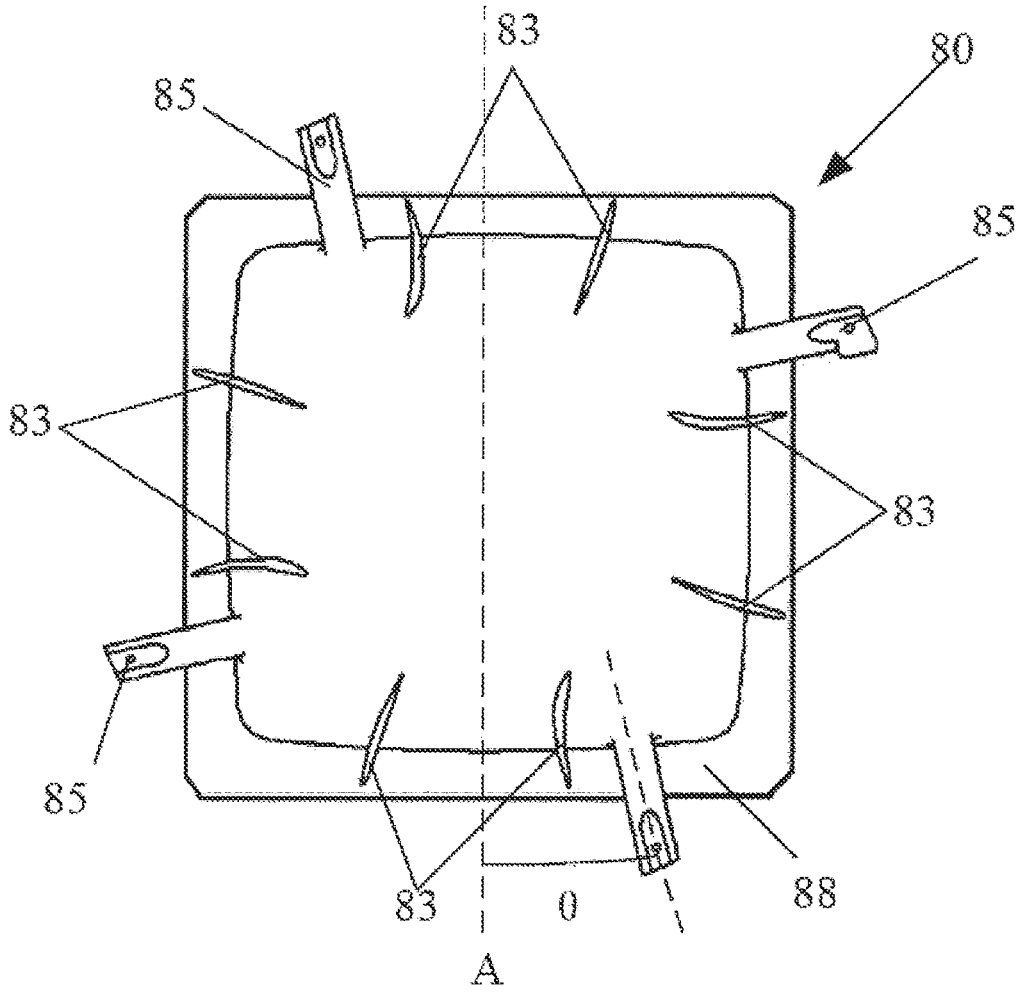
FIG. 5 is a front view of the housing for housing the electric component according to one or more embodiments of the present invention.

According to one or more embodiments of the present invention, the electric box 61 is mounted inside a housing 80 and thereby disposed on the blow-out side of the axial fan 50. FIGS. 4 and 5 illustrate the housing 80 for the electric component according to one or more embodiments of the present invention. As illustrated in FIGS. 4 and 5, the housing 80 has a substantially quadrate contour. However, the shape of the housing 80 is not limited thereto, and the contour of the housing 80 may have a circular shape. The housing 80 is similar to an inverted discoid container in an overall view. A side of the housing 80, the side facing the axial fan 50, (that is, the outer side of the housing 80) is formed in a projecting surface 86 which has a "projecting" shape and projects outward in an overall view. The projecting surface 86 may be a continuous arc-shaped surface projecting outward, a protruding truncated cone, or another protruding shape having a small top and a large bottom. The top of the projecting surface 86 is higher than the lowest end of the fin 51 of the axial fan 50. The edge around the projecting surface 86 may include a horizontally extending part 88 which horizontally extends. In a state in which the air guide fin 32 in the blow-out panel 30 is closed, the horizontally extending part 88 is horizontally aligned with the air guide fin 32 disposed on the blow-out panel 30. Thus, it is possible to prevent the entry of dust and, in addition, enhance the appearance of the blow-out panel.

The housing 80 is recessed to one side of the blow-out panel 30 (that is, the inner side of the housing 80) to form a mounting surface, and the electric component 60 is mounted on the mounting surface with a fastener (not illustrated).

According to one or more embodiments, the electric component 60 is the electric box 61. As shown in FIG. 1, the entire electric box 61 is mounted on the recessed mounting surface of the housing 80. Alternatively, the mounting surface of the housing 80 may be a flat surface to facilitate the fixing of the electric component. In order to reduce the overall height of the air conditioning indoor unit 1, according to one or more embodiments of the present invention, the housing 80 for housing the electric component 60 is at least partially fitted into a central recess surrounded by the fin 51 of the axial fan 50. In particular, the projecting surface 86 projecting outward of the housing 80 is at least partially fitted into the central recess surrounded by the fin 51 of the axial fan 50. As shown in the side sectional view of the air conditioning indoor unit 1 of FIG. 2, the topmost part of the housing 80 is higher than a plane where the lowest edge of the fin 51 of the axial fan 50 is located. The most projecting part of the projecting surface 86 of the housing 80 may be aligned with the axis of the axial fan 50. Accordingly, the overall height of the indoor unit is reduced, which results in a small height of a space required to be left inside the suspended ceiling and a small mounting space for the indoor unit. Thus, a feeling of pressure caused by a too low ceiling can be avoided.

As illustrated in FIGS. 1, 4, and 5, the housing 80 is fixed to the main body 10 or the blow-out panel 30 of the air conditioning indoor unit 1 with a plurality of support rods 85. According to one or more embodiments, the housing 80 is supported on the air guide ring 21 with the support rods 85. The other end of each of the support rods 85 is fixed to the edge of the projecting surface 86 projecting outward of the housing 80. Thus, the housing 80 is fixed to the air guide ring 21.

The housing 80 for the electric component 60 is fixed to the main body 10 or the blow-out panel 30 of the air conditioning indoor unit 1 with the support rods 85. The housing 80 may be fixed to the air guide member or the drain board of the main body internal member. As illustrated in FIG. 1, the housing 80 may be supported on the air guide ring 21 with the support rods 85. On end of each of the support rods 85 is fixed to the blow-out edge of the air guide ring 21, and the other end of each of the support rods 85 is fixed to the edge of the projecting surface 86 projecting outward of the housing 80. Thus, the housing 80 is fixed to the air guide ring 21.

The housing 80, the support rods 85, and the air guide ring 21 may be integrally formed of a resin material. In this case, the housing 80 is formed as a part of the main body internal member. The housing 80 and the air guide ring 21 may be integrally formed. In assembly of the air conditioning indoor unit 1, when the axial fan 50 is mounted inside the case 18, the housing 80 and the air guide ring 21 are both fitted with the inside of the case 18, and the housing 80 is located on the blow-out side of the axial fan 50. Further, the electric component 60 can be mounted on the mounting surface of the housing 80. In this case, the axial fan 50 and the electric component 60 are separated by the housing 80. Instead of this mode, the housing 80 may be connected to the air guide ring 21 with a fastening part which is disposed on the end of each of the support rods 85. In this case, using the housing and the air guide ring according to one or more embodiments of the present invention simplifies the structure, and, in addition, facilitates the mounting and also enhances the strength. Instead of this mode, the housing 80 may be fixed to the bottom side face of the drain board 26, the bottom side face facing the blow-out panel 30, with the support rods 85. According to one or more embodiments, when the housing 80 is mounted inside the air conditioning indoor unit 1, the corners of the housing 80 are aligned with the corners of the blow-out panel 30, and the linear edges of the housing 80 face the linear edges of the side parts 11 of the main body 10 and the blow-out panel 30. FIG. 1 illustrates four support rods 85. As shown in FIGS. 4 and 5, the four support rods 85 are located at positions close to diagonal lines of the square contour of the housing 80, but not disposed right on the corners and displaced in the same direction (in the clockwise direction) from the diagonal lines. Specifically, the support rods 85 are displaced by a certain distance from the corners to the downstream side in the rotation direction of the axial fan 50. That is, the support rods 85 are displaced by a certain distance from the corners of the blow-out panel 30 or the corners of the main body 20 to the downstream side in the rotation direction of the axial fan 50. This reduces interruption of air flows flowing through the corners caused by the support rods.

According to one or more embodiments, the housing 80 is mounted inside the case 18 in such a manner that the corners of the housing 80 face the respective corners of the case, and the linear edges of the housing 80 face the respective side parts 11 of the case 18. That is, the support rods 85 are displaced from the diagonal lines of the rectangular section of the main body 10. The displaced direction of the support rods 85 is a direction corresponding to the blow-out direction of the axial fan 50. Specifically, the support rods 85 displaced from the corners do not extend in the radial direction of the rotation axis of the axial fan 50, but are inclined by a certain angle in the rotation direction of the axial fan 50 with respect to the radial direction. For example, as illustrated in FIG. 5, since the axial fan 50 rotates in the clockwise direction in plan view, the drawn air flow has an air volume in the clockwise direction. Corresponding to this, the support rods 85 are inclined in the clockwise direction with respect to the radial direction of the axial fan 50. As compared to a mode in which the support rods 85 are disposed right at the positions corresponding to the diagonal lines, the displaced support rods 85 uniformly distribute air flows around the rotation axis of the axial fan 50 and reduce the interruption of air flows at the corners. In particular, as illustrated in FIG. 3, when the blow-out ports of the blow-out panel 30 are disposed around the whole circumference of the panel, the displaced support rods 85 can prevent the air volume at the corners from apparently differing from the air volume at the linear edges of the blow-out panel 30. As illustrated in FIG. 5, according to one or more embodiments, an angle θ between the support rod 85 and a center line A of the housing 80 which is orthogonal to the air guide fin 32 of the blow-out panel 30 is within the range of 10° to 15°. The angle θ may be 12.5°. Such disposition makes it possible to reduce the interruption of air flows at the corner caused by the support rod and, in addition, guide air flows to the corner using the support rod 85 itself.

It is more important to achieve uniform distribution of air flows at 360° around the rotation axis by a joint action of the support rods 85 displaced with respect to the diagonal lines and air guide pieces 83 on the projecting surface projecting outward of the housing 80.

As shown in FIG. 4, a plurality of air guide pieces 83 are disposed on the edge of the projecting surface projecting outward of the housing 80. The air guide pieces 83 are disposed on the edge substantially parallel to the axis of the axial fan 50 so that air flows blown out of the axial fan 50 are uniformly distributed. According to one or more embodiments as illustrated in FIG. 4, eight air guide pieces 83 in total are used as an air guide structure, and two of the air guide pieces 83 are disposed on the edge of each side. Each air guide piece 83 is vertically disposed on the edge of the projecting surface 86 projecting outward. Each air guide piece 83 may be displaced in the air flowing direction. Further, the number of air guide pieces 83 may be changed. For example, three air guide pieces may be disposed on each edge. Each air guide piece 83 includes an intake end which faces the axial fan 50 and a blow-out end which is opposed to the intake end. In order to specifically adjust each air guide piece 83 so that blown-out air flows are uniformly distributed, the air guide piece 83 is displaced with respect to the radial direction of the axial fan 50. Accordingly, air flows are guided from the side where air flows are concentrated to the side where there is an air flow loss. According to one or more embodiments, since air flows at the corners of the air conditioning indoor unit 1 are weak, the blow-out ends of some of the air guide pieces 83 (normally, the air guide pieces 83 close to the support rods 85) are displaced to the corners as illustrated in FIG. 4. Corresponding to this, when the housing 80 is mounted inside the case 18, the blow-out ends of these air guide pieces 83 are displaced toward the corners of the blow-out panel 30 of the air conditioning indoor unit 1.

As shown in FIGS. 4 and 5, a plurality of air guide pieces 83 are disposed on the edge of one side face of the housing 80, the side face facing the axial fan 50. The air guide pieces 83 may be integrally molded with the housing 80. However, the air guide pieces 83 may be fixed to the edge of the housing 80 by another fixing method. The air guide pieces 83 are used as the air flow guide structure. For example, as will described in detail later, the air guide pieces 83 are set at specific angles. Such setting allows blown-out air flows to be uniformly led out through the blow-out ports 31 of the blow-out panel 30.

Figure 7:
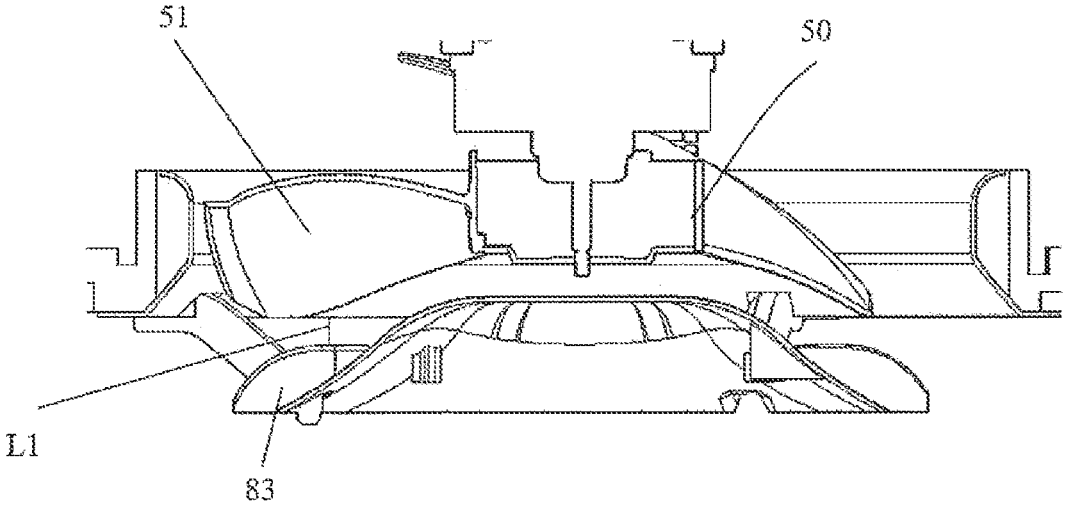
FIG. 7 is a local side view of the air conditioning indoor unit according to one or more embodiments of the present invention illustrating an axial fan and the housing.

The housing 80 has a substantially quadrate contour in a plane orthogonal to the axis of the axial fan 50. Corresponding to this, the housing 80 includes four sides and four corners. When the housing 80 is attached to the quadrate main body 10 of the air conditioning indoor unit 1 which includes the quadrate blow-out panel 30 as illustrated in FIG. 7, the corners of the housing 80 are basically aligned with the respective corners of the blow-out panel 30.

The blow-out panel 30 includes the corners, and the volume of air flowing through the corners of the blow-out panel 30 is small when air flows generated by the axial fan 50 are blown out. Air flows can be guided to the corners of the blow-out panel 30 by disposing the support rods 85 in a manner to be displaced by a certain distance from the corners of the blow-out panel 30 or the corners of the main body 20 to the downstream side in the rotation direction of the axial fan 50.

Figure 6A:
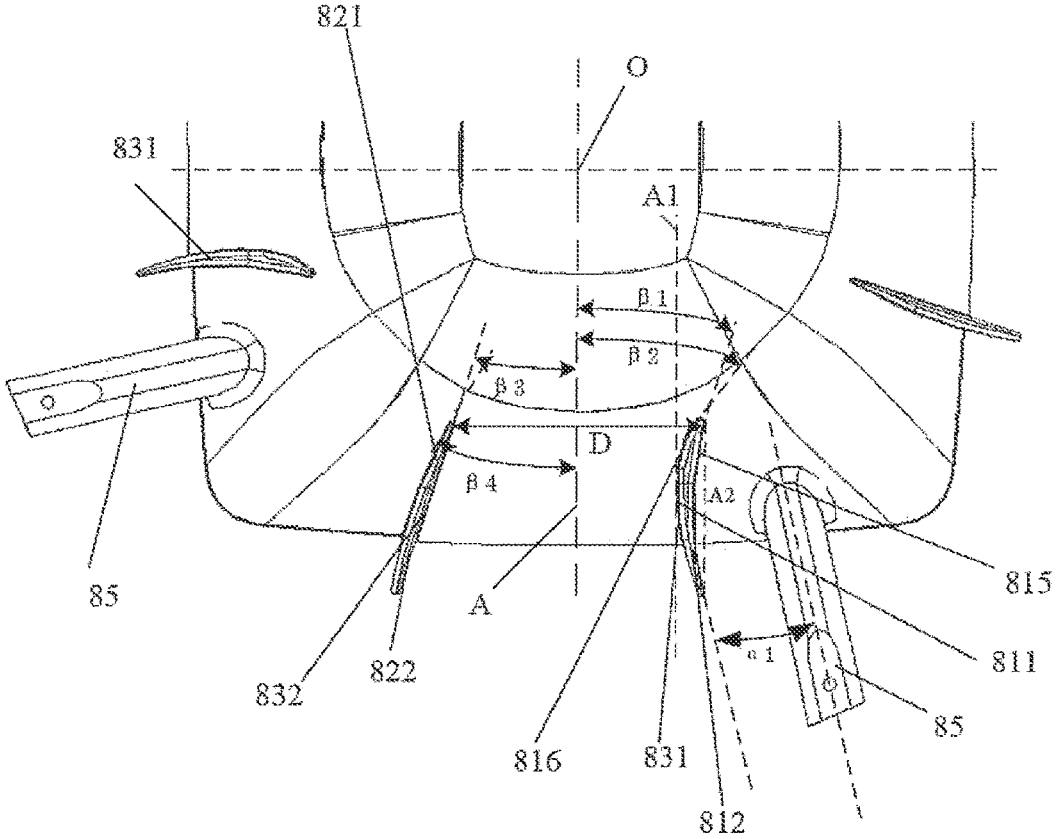
FIG. 6A is an enlarged schematic view illustrating details of a part of the housing for housing and mounting the electric component according to one or more embodiments of the present invention.

As illustrated in FIG. 6A, each side of the housing 80 is provided with two air guide pieces, that is, a first air guide piece 831 and a second air guide piece 832. The first air guide piece 831 is located on the right side of the center line A of the housing 80. The second air guide piece 832 is located on the right side of the center line A of the housing 80. The center line A of the housing is an axis that is perpendicular or orthogonal to the air guide fin 32 of the blow-out panel 30 through the center of the housing 80 on a lateral-direction section (that is, a plane perpendicular to the axis of the axial fan 50) of the main body 10.

Figure 6B:
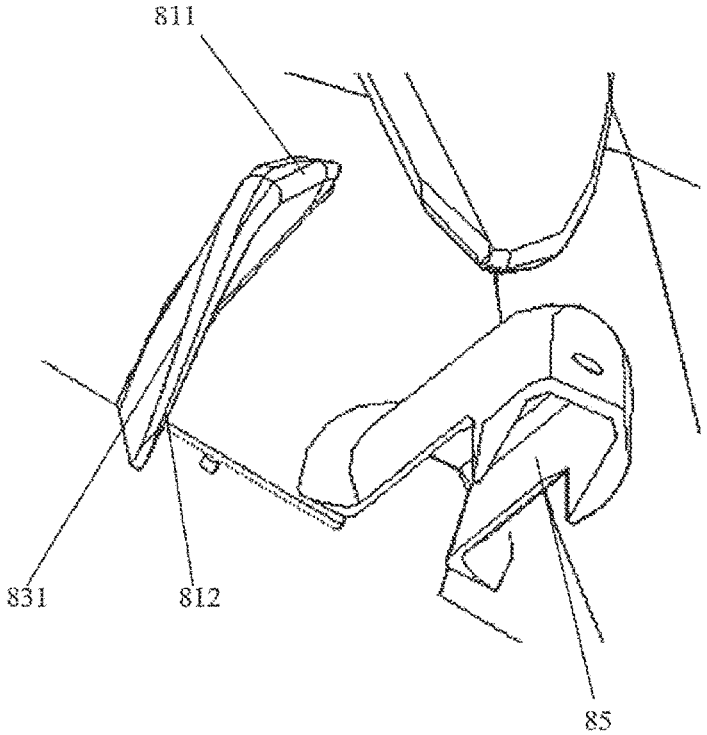
FIG. 6B is an enlarged perspective view illustrating details of a part of the housing for housing and mounting the electric component according to one or more embodiments of the present invention.

As illustrated in FIG. 6A, the first air guide piece 831 includes an intake part 811 and a blow-out part 812. The blow-out part 812 is distorted toward the corner of the housing 80, and distorted also toward the corner of the blow-out panel 30 or the corner of the main body 10, correspondingly. As illustrated in FIG. 6B, the blow-out part 812 of the first air guide piece 831 is thin, which contributes to concentrating air flows into the blow-out part 812 to prevent the air flows from being separated. On the plane illustrated in FIG. 6A, an angle $\alpha$ is set between a tangent to the blow-out part 812 of the first air guide piece 831 at a blow-out end point and a straight line formed by projecting the support rod located on the same side on the plane, and the angle $\alpha$ may satisfy $5° \leq \alpha \leq 15°$, may satisfy $7° \leq \alpha \leq 10°$, or may satisfy $\alpha = 8.5°$.

Further, in the first air guide piece 831, the intake part 811 is thicker than the blow-out part 812. The intake part 811 of the first air guide piece 831 includes a windward surface 815 and a leeward surface 816. An angle $\beta 1$ is set between a tangent to the windward surface 815 at an intake end point and the center line A, an angle $\beta 2$ is set between the leeward surface 816 and the center line A, and the angle $\beta 1$ is smaller than the angle $\beta 2$. The angle $\beta 1$ may be 13° or larger and 23° or smaller, and the angle $\beta 2$ may be 25° or larger and 35° or smaller. Alternatively, the angle $\beta 1$ may be 18.5°, and the angle $\beta 2$ may be 30.8°.

Further, as illustrated in FIG. 6A, a tangent A1 to the leeward surface of the first air guide piece 831 at a point having the shortest distance from the center line A is substantially parallel to the center line A.

Further, a line A2 connecting the intake end point to the blow-out end point of the first air guide piece 831 is substantially parallel to the center line A.

In the first direction, the first air guide piece 831 is disposed downstream of the support rod 85, and the distance between the first air guide piece and the center line A of the housing 80 is smaller than the distance between the support rod 85 and the center line A of the housing 80. Thus, the first air guide piece 831 is capable of guiding an air flow closer to the center line A of the housing 80 to the corner of the blow-out panel 30.

Air flows blown out of the axial fan 50 are more actively guided to the corners of the blow-out panel 30 and thereby uniformly guided by the joint action of the support rods 85 and the first air guide pieces 831.

Further, as illustrated in FIG. 7, a minimum distance L1 is set between the outer edge of the air guide piece 831 and the fin 51 of the axial fan 50 in the axial direction of the axial fan 50, and the length L1 may satisfy 10 mm≤L1≤20 mm or may satisfy L1=15 mm.

As shown in FIG. 6, the second air guide piece 832 is disposed downstream of the first air guide piece 831 on the same side of the housing 80. A distance D is set between the second air guide piece 832 and the first air guide piece 831, and the distance D typically satisfies D≥60 mm.

The set angle of the second air guide piece 832 differs from that of the first air guide piece 831. Similarly, the second air guide piece 832 includes an intake part 821 and a blow-out part 822. The blow-out part 822 of the second air guide piece 832 is substantially perpendicular to the side of the housing 80. Corresponding to this, the blow-out part 822 is also perpendicular to the air guide fin 32 of the blow-out panel 30. Accordingly, air flows flow to the blow-out port perpendicularly along the blow-out part 812.

Further, as illustrated in FIG. 6A, the intake part 821 of the second air guide piece 832 is distorted toward the center line A. The intake part 821 includes a windward surface and a leeward surface. An angle $\beta 3$ between a tangent to the windward surface of the intake part 821 at an intake end point and the center line A is smaller than an angle $\beta 4$ between a tangent to the leeward surface of the intake part 821 at the intake end point and the center line A ($\beta 3 < \beta 4$).

The second air guide piece 832 may include a windward surface and a leeward surface. A tangent to the leeward surface of the second air guide piece 832 at an intake end point passes through a center point O of the housing 80. The center point O of the housing 80 may be located on the rotation axis of the axial fan 50.

Figure 9A:
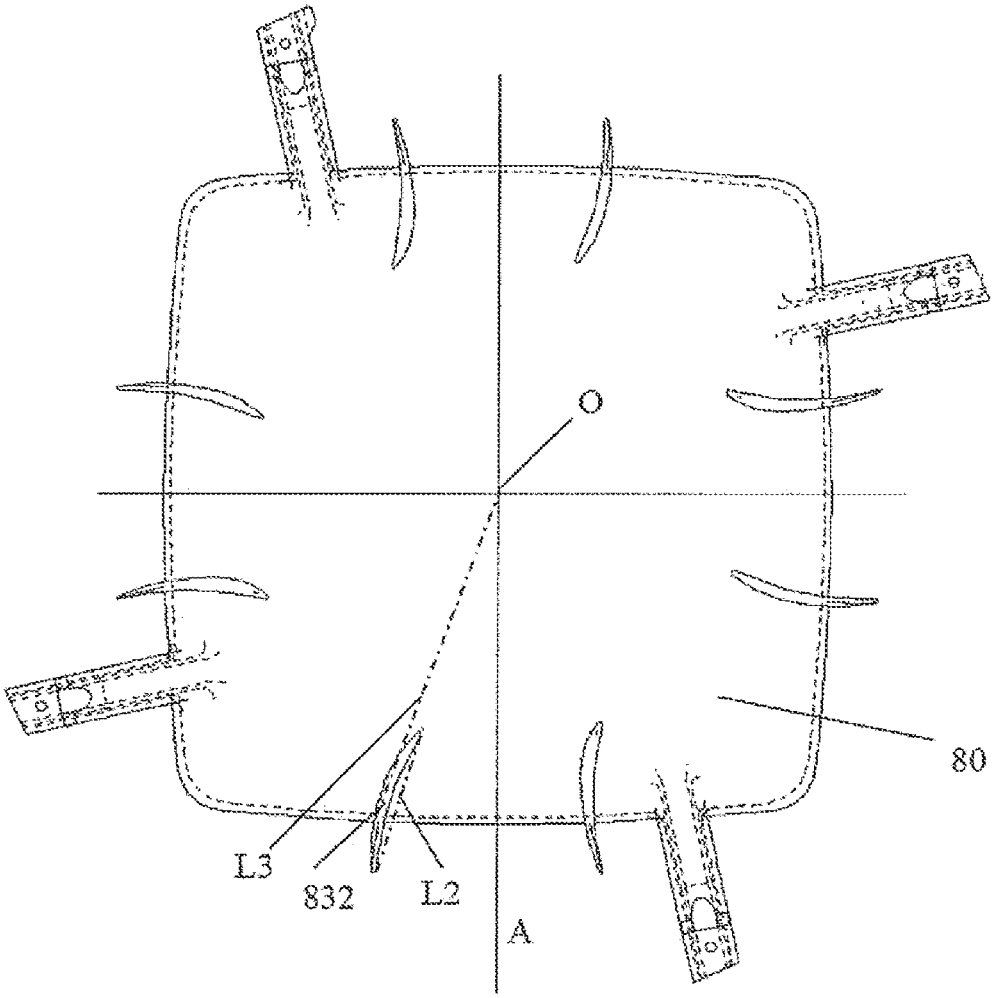
FIG. 9A is a plan view of a housing of an air conditioning indoor unit according to one or more embodiments of the present invention.

In addition to or instead of the above configuration, a configuration as illustrated in FIG. 9A may be employed. In FIG. 9A, on the windward surface, a line L2 connects the intake end point to the blow-out end point of the second air guide piece 832. The leeward surface of the second air guide piece 832 and the edge of the housing 80 intersect each other at a second point which is connected to the center point O by a line L3. The line L2 may be substantially parallel to the line L3.

Figure 9B:
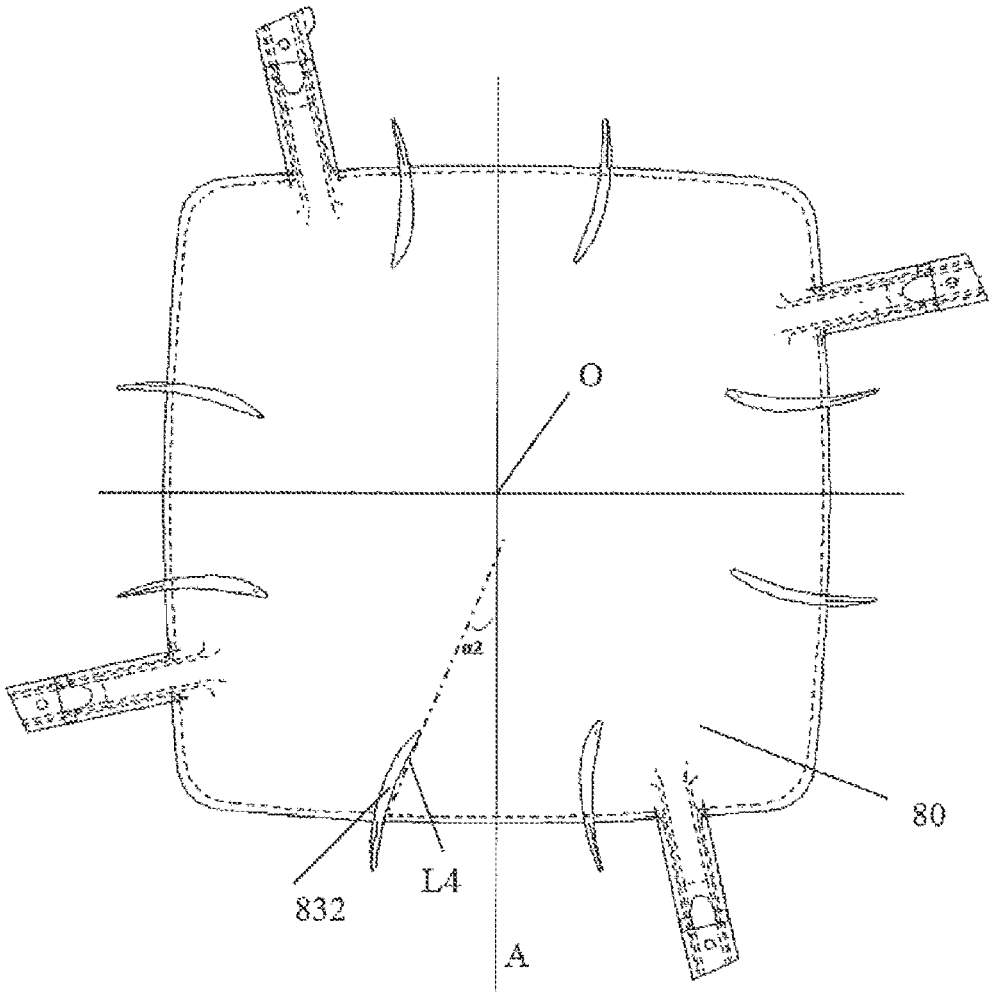
FIG. 9B is a plan view of a housing of an air conditioning indoor unit according to one or more embodiments of the present invention.

In addition to or instead of the above configuration, a configuration as illustrated in FIG. 9B may be employed. In FIG. 9B, the windward surface of the second air guide piece 832 and the edge of the housing 80 intersect each other at a first point. An angle $\alpha 2$ is set between a line L4 connecting the first point to the intake end point on the windward surface of the second air guide piece 832 and the center line A. Further, the angle $\alpha 2$ satisfies $12° \leq \alpha 2 \leq 25°$. The angle $\alpha 2$ may satisfy $15° \leq \alpha 2 \leq 20°$, or may satisfy $\alpha 2 = 18.5°$.

When the size of the housing 80 is relatively large, a third air guide piece (not illustrated) may be further disposed downstream of the second air guide piece 832 in the rotation direction of the axial fan 50 to further assign priorities to the air guide effect. Similarly, the third air guide piece includes an intake part and a blow-out part. The blow-out part of the third air guide piece is substantially perpendicular to the air guide fin 32 of the blow-out panel 30.

When N air guide pieces 83 are disposed on one side edge of the quadrate housing 80 (N is a natural number of 2 or larger), the air guide pieces 83 are disposed at positions set by equally dividing the one side edge of the housing 80 by N+1. When N air guide pieces 83 are disposed (N is a natural number of 2 or larger), intersections between the leeward surfaces of the air guide pieces 83 and the edge may be disposed at the positions set by equally dividing the one side edge of the housing 80 by N+1. As shown in FIG. 7, each air guide piece 83 extends beyond the edge of the housing 80. Each air guide piece 83 may not extend beyond the radial outer edge of the fin 51 of the fan 50 in the radial direction. In other words, in the radial direction with respect to the axis of the axial fan 50, the outer edge of each air guide piece 83 is located inside the outer edge of the fin 51 of the axial fan 50 in the radial direction.

The radial outermost ends of all the air guide pieces 83 of one housing 80 may be located on the same circumference of a circle surrounding the rotation axis of the axial fan 50, and the circumference of the circle is concentric with the air guide ring 21.

In order to reduce the overall height of the air conditioning indoor unit 1, according to one or more embodiments, the housing 80 for housing the electric component 60 is at least partially fitted into the central recess surrounded by the fin 51 of the axial fan 50 as illustrated in FIG. 2. In particular, the projecting surface 86 projecting outward of the housing 80 is at least partially fitted into the central recess surrounded by the fin 51 of the axial fan 50. As shown in the side sectional view of the air conditioning indoor unit 1 of FIG. 2, the topmost part of the housing 80 is higher than the plane located at the lowest edge of the fin 51 of the axial fan 50. As illustrated in FIG. 7, the air guide piece of the housing 80 is located under the fin 51, and the radial outer edge of the air guide piece 83 is located inside the radial outer edge of the fin 51. That is, in plan view, the air guide piece 83 extends not beyond the radial outer edge of the fin 51.

Further, as a necessary point, the air guide piece 83 does not extend up to the position of the blow-out port 31 of the blow-out panel 30. The extending range of the air guide piece 83 in the housing 80 does not beyond the inner frame 35 of the blow-out panel 30. Accordingly, the inner frame 35 is located under the radial outer edge of the air guide piece 83. Thus, air flows guided by the air guide piece 83 are not separated, but concentrated before flowing to the blow-out port.

FIG. 8 illustrates a side sectional view of the air conditioning indoor unit according to one or more embodiments of the present invention. According to one or more embodiments, a blow-out panel 30 includes an inner frame 35, an outer frame 33, a blow-out port 31 which is interposed between the inner frame 35 and the outer frame 33, and an air guide fin 32 which is pivotally supported and attached to the blow out panel 30. The outer frame 33 of the blow-out panel 30 includes a guide part 36 which is located downstream of a blow-out port of an air guide ring 21. The guide part 36 includes an oblique surface or an arc surface projecting outward. The guide part 36 may extend over the whole circumference around the rotation axis of an axial fan 50.

The guide part 36 is a part integrated with the outer frame 33 of the blow-out panel 30. The guide part 36 is provided as a single individual member and, for example, integrally molded of resin. The individual member may be fitted with the blow-out panel with a fixing device such as an engagement structure or a fastener so as to be formed as a part of the outer frame 33.

An air blow passage is formed between a projecting surface 86 on the upper side of a housing 80 and the guide part 36. The air blow passage allows air flows to smoothly flow to the blow-out port of the blow-out panel 30 from the air guide ring 21. As shown in FIG. 8, an air guide piece 83 of the housing 80 extends inside the air blow passage formed by the projecting surface 86 and the guide part 36.

In the air conditioning indoor unit 1 according to one or more embodiments of the present invention, the air guide piece 83 is disposed on the housing 80 for the electric component located on the blow-out side under the axial fan 50. Thus, air flows blown out of the axial fan 50 are uniformly distributed. In particular, the blow-out part 812 of each air guide piece 83 is distorted to the corner of the blow-out panel 30 or the corner of the main body 10, which reduces an air flow loss at the corner and achieves air-blowing at 360° by the blow-out panel.

The support rod 85 for holding the housing 80 is displaced by a certain distance from the corner of the main body 10 or the blow-out panel 30 to the downstream side in the rotation direction of the axial fan. Thus, the interruption of air flows at the corner is reduced.

The intake part and the blow-out part 812 of the air guide piece 83 at the edge of the housing 80 are set at specific angles with respect to the center line of the housing 80. In the intake part, the angle between the windward surface and the center line differs from the angle between the leeward surface and the center line. Thus, air flows are extremely uniformly blown out through the blow-out port, which maximizes comfort for human.

Further, in the air conditioning indoor unit 1 according to one or more embodiments of the present invention, the interruption action to air flows by the air guide piece 83 is extremely small Thus, noise to be generated is minimized.

In order to reduce the interruption action to air flows by the support rod 85, the windward surface of the support rod 85 facing air flows may be formed in an arc shape projecting outward. Alternatively, the section of the support rod 85 perpendicular to the extending direction thereof is formed in an olive shape having two sharp tips and a rough center.

Further, as illustrated in FIG. 6B, the windward surface of the support rod 85 is a projecting arc-shaped surface, which further reduces the interruption of air flows at the corner by the support rod. The electric component 60 housed in the housing 80 requires wiring. In order to facilitate the array of cables of the electric component 60, a wiring part, for example, a cable housing groove may be formed on the leeward surface of the support rod 85 opposed to air flows. Cables of the electric component 60 are arrayed along the leeward surface of the support rod 85, which facilitates the arrangement of cables and, in addition, reduces the interruption of air flows at the corner.

On the other hand, the support rod 85 extends in the direction away from the rotation axis of the axial fan 50 from the housing 80. The support rod 85 becomes gradually thinner in the extending direction, which further reduces the interruption action to air flows and guides air flows so that the air flows are uniformly distributed.

According to one or more embodiments, the housing 80 may be fixed to the blow-out panel 30. Specifically, the edge of the housing 80 may be connected to the back face of the blow-out panel 30, and the cover plate 70 may directly cover the mounting surface of the housing 80. The cover plate 70 may be connected to the blow-out panel 30 with an engagement structure. When it is necessary to perform maintenance or replacement of the electric component 60 inside the housing 80, the maintenance operation can be performed merely by removing the cover plate 70 (from the blow-out panel 30) from under the ceiling.

As illustrated in FIG. 3, the cover plate 70, which is located at an intermediate position between the blow-out ports 31 of the blow-out panel 30, has a quadrate shape. However, the cover plate 70 may have another shape. The cover plate 70 is commonly molded of resin. For example, an LED light may be directly mounted inside the housing 80, and the cover plate 70 made of a transparent resin may be used, so that light from the LED light is emitted through the transparent cover plate 70.

Further, the air conditioning indoor unit 1 according to one or more embodiments of the present invention may be modified as another mode. For example, the air conditioning indoor unit may be formed in a cylindrical shape as a whole. A main body of the air conditioning indoor unit is formed in a cylindrical shape, and includes a tubular case. An axial fan, a heat exchanger, a drain board, and an air guide member are housed inside the tubular case. A blow-out panel may be formed in a circular shape. A blow-out port is disposed around the blow-out panel. An intake surface is formed on an arc side part of the cylindrical main body. Similarly, an electric component is disposed under an axial fan.

According to the air conditioning indoor unit 1 according to one or more embodiments of the present invention, the axial fan 50 draws air from the side part 11 and blows out air from the bottom side. Thus, the overall size of the air conditioning indoor unit in the vertical direction is reduced, which makes it possible to reduce the height of the ceiling space. For example, according to one or more embodiments, the cooling efficiency can satisfy a predetermined requirement while maintaining the overall height of the air conditioning indoor unit 1 at 300 mm or lower.

In order to facilitate mounting, the blow-out panel may be formed in a quadrate shape of 640 mm×640 mm. On the other hand, the case 18 to be fitted inside the ceiling may have a size of 580 mm×580 mm. The air conditioning indoor unit 1 having such a size can be particularly applied to mounting to an integrated ceiling. Specifications of a buckle plate of the integrated ceiling mainly include 300 mm×300 mm and 600 mm×600 mm. The air conditioning indoor unit 1 according to one or more embodiments of the present invention may be mounted after removing a ceiling module. For example, four ceiling modules are removed in the case of 300 mm×300 mm and one ceiling module is removed in the case of 600 mm×600 mm, and it is not necessary to perform another operation on the ceiling. The panel has a size that exactly covers a slit of an opening. Further, the air conditioning indoor unit 1 having such a configuration may be mounted inside an opening open on the integrated ceiling.

Further, the electric component 60 of the air conditioning indoor unit 1 according to one or more embodiments of the present invention is mounted in intimate contact with the blow-out panel 30 on the blow-out side of the axial fan 50. Thus, maintenance of the electric component 60 is extremely easy. The operation can be performed from under the ceiling by merely removing the cover plate 70 which is located in the intermediate part of the blow-out panel 30.

Further, air flows blown out through a space between the edge of the air guide ring 21 and the edge of the housing 80 are uniformly distributed at 360° around the rotation axis by the arrangement of the support rod 85 and the air guide piece 83 of the housing 80 for the electric component 60. Blowing-out by the air conditioning indoor unit 1 is smooth and uniform, saves energy, and improves comfort for human by the joint action with the air guide fin 32 which is individually controlled by the stepping motor.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 indoor unit
10 main body
11 side part
18 case
21 air guide member (air guide ring)
26 drain board
30 blow-out panel
31 blow-out port
32 air guide fin
33 outer frame
35 inner frame
36 guide part
40 heat exchanger
50 axial fan
51 fin
60 electric component
61 electric box
70 cover plate
80 housing
83 air guide piece
831 first air guide piece
811 intake part of first air guide piece
812 blow-out part of first air guide piece
815 windward surface of intake part of first air guide piece
816 leeward surface of intake part of first air guide piece
832 second air guide piece
821 intake part of second air guide piece
822 blow-out part of second air guide piece
85 support rod
86 projecting surface
88 horizontally extending part

The invention claimed is:

1. An air conditioning indoor unit comprising:
a main body that comprises:
a top side;
a bottom side;
a side part that connects the top side to the bottom side; and
an intake surface on the side part;
a blow-out panel that at least partially covers the bottom side of the main body and that comprises a blow-out port;
an axial fan disposed inside the main body, wherein
the axial fan has an axial direction orthogonal to the top side,
the axial fan has an intake side and a blow-out side, and
the blow-out side is disposed on a lower side of the axial fan and faces the blow-out panel;
a heat exchanger that is disposed inside the intake surface and that surrounds the axial fan;
an electric component under the axial fan; and
a housing that is at least partially disposed in a central part of the air conditioning indoor unit, wherein the central part is surrounded by a fin of the axial fan.

2. The air conditioning indoor unit according to claim 1, wherein
the housing comprises an air guide structure disposed at an edge of the housing on a side that faces the axial fan.

3. The air conditioning indoor unit according to claim 2, wherein
the air guide structure comprises a first air guide piece that comprises a first intake part and a first blow-out part, and
the first blow-out part is distorted toward a corner of the blow-out panel or a corner of the main body.

4. The air conditioning indoor unit according to claim 3, wherein
the axial fan rotates in a first direction to draw air through the intake surface and blow the air out through the blow-out port,
the housing further comprises a second air guide piece disposed downstream of the first air guide piece in the first direction,
the first air guide piece and the second air guide piece guide air flow within the air conditioning indoor unit to an air guide fin on a same side of the blow-out panel,
the second air guide piece comprises a second intake part and a second blow-out part, and
the second blow-out part is substantially orthogonal to the air guide fin.

5. The air conditioning indoor unit according to claim 4, wherein the housing includes a center point, the second air guide piece comprises a windward surface and a leeward surface, and a tangent to the leeward surface of the second air guide piece at an intake end point passes through the center point.

6. The air conditioning indoor unit according to claim 4, wherein the housing includes a center point, the second air guide piece extends beyond an edge of the housing, the second air guide piece comprises a windward surface and a leeward surface, a line L2 connects an intake end point to a blow-out end point on the windward surface of the second air guide piece, the leeward surface of the second air guide piece intersects the edge of the housing at a second point, a line L3 connects the second point to the center point, and the line L2 is substantially parallel to the line L3.

7. The air conditioning indoor unit according to claim 3, wherein the housing includes a center line, the first air guide piece comprises a windward surface and a leeward surface, and a tangent to the leeward surface of the first air guide piece at a point having a shortest distance from the center line is substantially parallel to the center line, or a line connecting an intake end point to a blow-out end point on a windward surface of the first air guide piece is substantially parallel to the center line.

8. The air conditioning indoor unit according to claim 3, wherein the blow-out part is distorted toward both of the corner of the blow-out panel and the corner of the main body.

9. The air conditioning indoor unit according to claim 2, wherein the axial fan rotates in a first direction to draw air through the intake surface and blow the air out through the blow-out port, the housing is fixed to the main body or the blow-out panel with a support rod, and the air guide structure comprises a first air guide piece disposed downstream of the support rod in the first direction.

10. The air conditioning indoor unit according to claim 9, wherein the blow-out panel has a corner, and the support rod is displaced from the corner toward a downstream side in the first direction.

11. The air conditioning indoor unit according to claim 9, wherein the first air guide piece comprises a windward surface and a leeward surface, and $\beta 1$ is smaller than $\beta 2$ where $\beta 1$ is an angle between a tangent to the windward surface of the first air guide piece at an intake end point and a center line of the housing (80), wherein the center line is orthogonal to an air guide fin of the blow-out panel, and $\beta 2$ is an angle between a tangent to the leeward surface of the first air guide piece at the intake end point and the center line.

12. The air conditioning indoor unit according to claim 9, wherein the support rod comprises:

a windward side that faces an air flow in the air conditioning indoor unit;

a leeward side that opposes the air flow, and a wiring part disposed on the leeward side.

13. The air conditioning indoor unit according to claim 2, wherein the housing has a quadrate shape, the air guide structure is an air guide piece, and when N air guide pieces are disposed on the edge of the housing and N is a natural number greater than or equal to 2, the N air guide pieces are disposed at positions that equally divide the edge of the housing by N+1.

14. The air conditioning indoor unit according to claim 2, wherein the air guide structure is an air guide piece that extends parallel to an axis of the axial fan.

15. The air conditioning indoor unit according to claim 1, further comprising:

a cover plate disposed on a center of the blow-out panel and aligned with the electric component; and a housing for the electric component, wherein the electric component comprises at least one of an electric box, a control device, an LED light, a wireless communication device, an air valve, a motor-operated valve, and a projector device.

* * * * *